US007972056B2

(12) United States Patent
Lontoc

(10) Patent No.: US 7,972,056 B2
(45) Date of Patent: Jul. 5, 2011

(54) MACHINE FOR MIXING HAIR COLORS

(76) Inventor: Jean Lontoc, Lutz, FL (US)

( * ) Notice: Subject to any disclaimer, the term of this patent is extended or adjusted under 35 U.S.C. 154(b) by 866 days.

(21) Appl. No.: 11/959,792

(22) Filed: Dec. 19, 2007

(65) Prior Publication Data

US 2009/0161481 A1 Jun. 25, 2009

(51) Int. Cl.
*B01F 3/10* (2006.01)
*B01F 13/00* (2006.01)
*B01F 15/02* (2006.01)

(52) U.S. Cl. ..... 366/150.1; 366/177.1; 366/184

(58) Field of Classification Search ..... 366/150.1, 366/130, 189, 177.1, 184, 182.1; 222/135, 222/101, 102
See application file for complete search history.

(56) References Cited

U.S. PATENT DOCUMENTS 2,068,646 A * 1/1937 Hexter ..... 366/185
2,528,530 A * 11/1950 Machleder ..... 206/222
2,819,738 A * 1/1958 Marberg ..... 141/1
2,881,954 A * 4/1959 Kirkpatrick et al. ..... 222/102
4,225,248 A * 9/1980 Para ..... 366/251
4,505,593 A * 3/1985 Miller et al. ..... 366/152.2
4,575,375 A * 3/1986 Kozam ..... 222/96
4,585,148 A * 4/1986 Ito ..... 222/77
4,941,520 A * 7/1990 Dowzall et al. ..... 366/130
5,160,198 A * 11/1992 Fillon ..... 366/198
5,468,068 A * 11/1995 Hotchkiss, III ..... 366/348
5,511,876 A * 4/1996 Plessers et al. ..... 366/153.1
5,554,197 A * 9/1996 Assini et al. ..... 221/1
5,833,120 A * 11/1998 Evans et al. ..... 222/95
5,934,344 A * 8/1999 Wainberg et al. ..... 141/83
5,972,043 A * 10/1999 Galvan et al. ..... 366/206
6,089,408 A * 7/2000 Fox ..... 222/144
6,196,712 B1 * 3/2001 Elm ..... 366/197
6,202,895 B1 * 3/2001 Fox ..... 222/144
6,926,171 B2 * 8/2005 Reedy et al. ..... 222/108
7,654,416 B2 * 2/2010 Buining et al. ..... 222/144
2004/0159676 A1 * 8/2004 Adema ..... 222/144
2007/0056989 A1 * 3/2007 Adema ..... 222/144
2008/0130398 A1 * 6/2008 Ponsford ..... 366/111
2009/0161481 A1 * 6/2009 Lontoc ..... 366/150.1

* cited by examiner

*Primary Examiner* — Tony G Soohoo
(74) *Attorney, Agent, or Firm* — Ronald E. Smith; Smith & Hopen, P.A.

(57) ABSTRACT

A countertop apparatus dispenses hair coloring, developers and bleach in specified quantities and mixes them, substantially reducing the manual labor involved in performing such tasks. A housing has an upstanding back wall and a bottom wall. A plurality of hair color tube stations is mounted on a forward side of the back wall and a hair color tube squeezing device is positioned at each hair color tube station. The hair color tube squeezing device includes a pair of confronting rollers that engage the trailing end of an inverted hair color tube. A plurality of developer reservoirs and a bleach hopper are also mounted to the apparatus. First and second mixing bowls receive and mix hair coloring and developer at first and second stations, and a third mixing bowl receives and mixes bleach and developer at a third station. Operation of the apparatus is keypad-controlled.

15 Claims, 6 Drawing Sheets

MACHINE FOR MIXING HAIR COLORS

BACKGROUND OF THE INVENTION

1. Field of the Invention

This invention relates, generally, to dispensing and mixing devices. More particularly, it relates to a machine that dispenses and mixes coloring agents, developers, and bleaching agents in measured amounts.

2. Description of the Prior Art

Hair coloring is sold in tubes that are initially hand-squeezed from the bottom. As the tube empties, the squeezing action is performed closer and closer to the outlet of the tube. The quantity is typically measured in ounces. Most hair-coloring jobs require an admixture of colors. Moreover, the colors must be mixed with a developer and in some cases a bleach is added as well. Accordingly, the tube-squeezing process is followed by a mixing process which is conventionally performed by hand.

Many people who work with hair color tubes, developers and the like may develop debilitating sprains, tendonitis, bursitis, or other injuries. There is a need, therefore, for a machine that performs the functions of tube squeezing and mixing.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved method of dispensing and mixing hair coloring, developers, and bleach is now met by a new, useful, and non-obvious invention. The inventive structure is a novel countertop apparatus that performs the functions of dispensing hair coloring, developers and bleach in specified quantities and mixing the same, thereby substantially reducing the manual labor involved in performing such tasks.

The novel apparatus includes a housing having an upstanding back wall and a bottom wall extending forwardly from a lower end of the back wall. At least one hair color tube station is mounted on a forward side of the back wall and a hair color tube squeezing means is positioned at each hair color tube station. Each hair color tube squeezing means is adapted to engage a trailing end of an inverted hair color tube.

A hair color dispenser control means controls each hair color tube squeezing means so that a preselected quantity of a preselected hair coloring is squeezed from each tube.

At least one reservoir is mounted to the apparatus and is adapted to hold a developer. A developer dispenser is positioned at a discharge end of each reservoir, and a developer dispenser control means controls the developer dispenser so that a preselected quantity of a preselected developer is dispensed from each reservoir.

At least one mixing bowl is positioned forwardly of the back wall below a discharge end of each hair color tube and the discharge end of each reservoir. A mixing means for mixing hair color and developer is provided with each mixing bowl.

The hair color tube squeezing means includes a pair of confronting rollers that engage the trailing end of a hair color tube.

In a first embodiment, each developer reservoir is mounted on a rearward side of the upstanding back wall and an opening is formed in the upstanding back wall for each reservoir so that a discharge end of each reservoir extends through an opening and is positioned forwardly of the upstanding back wall.

In a second embodiment, each developer reservoir is mounted forwardly of the upstanding back wall so no opening is formed in the upstanding back wall.

In both embodiments, each hair color tube squeezing means includes a motor for effecting counter-rotation of each pair of confronting rollers to accomplish squeezing of each hair color tube. The control means controls operation of each motor so that a preselected measured amount of hair color is squeezed from each hair color tube.

More particularly, the novel apparatus includes a first station dedicated to light colors. The first station includes a plurality of hair color tube stations, a plurality of tube squeezing means, a plurality of developer reservoirs, and a first mixing bowl.

The apparatus further includes a second station dedicated to regular colors. The second station includes a plurality of hair color tube stations, a plurality of hair color tube squeezing means, a plurality of developer reservoirs, and a second mixing bowl.

The apparatus further includes a bleaching station. The bleaching station includes a hopper adapted to hold bleach, a plurality of developer reservoirs, and a third mixing bowl. A bleach dispenser means is positioned at a discharge end of the bleach hopper, and a bleach dispenser control means controls the bleach dispenser so that a preselected quantity of bleach is dispensed from the hopper.

A first keypad enables a user to program the hair color dispenser control means and the developer dispenser control means of the first station so that a user may preselect any combination and quantity of hair colors and developers to be dispensed into the first mixing bowl.

A second keypad enables a user to program the hair color dispenser control means and the developer dispenser control means of the second station so that a user may preselect any combination and quantity of hair colors and developers to be dispensed into the second mixing bowl.

A third keypad enables a user to program the developer dispenser control means and the bleach dispenser control means of the third station so that a user may preselect any combination and quantity of developers and bleach to be dispensed into the third mixing bowl.

Alternatively, all three keypads may be combined into one keypad that includes the functions of the first, second, and third keypads.

The primary object of the invention is to reduce the labor required to dispense hair coloring from hair color tubes, dispense liquid developers, and dispense powdered bleach into a mixing bowl, and mixing the same manually.

A closely related object is to provide an easy-to-operate apparatus that performs the dispensing and mixing tasks with a minimal amount of human intervention.

Another important object is to provide the apparatus in a compact form so that it may sit atop a countertop.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
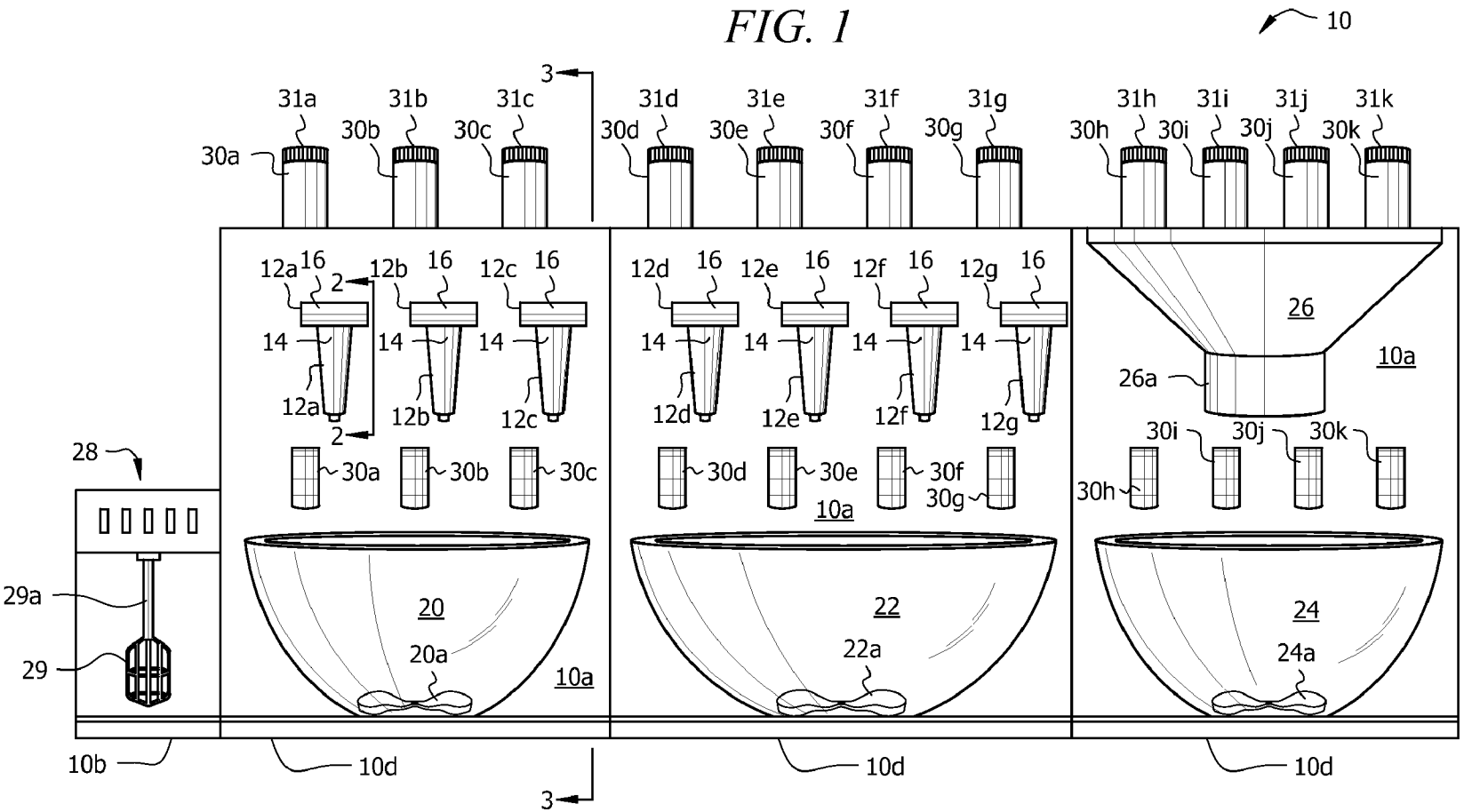
FIG. 1 is a front elevational view of the novel apparatus.

Referring now to FIG. 1, it will there be seen that an illustrative embodiment of the invention is denoted as a whole by the reference numeral 10.

Apparatus 10 is made mostly of plastic parts and has a size similar to that of a coffee maker so that it may be kept on a countertop. In a first embodiment, it includes a vertical back wall 10*a* and a horizontal bottom wall 10*b*. In FIG. 1, it appears that there are three (3) coplanar back walls 10*a* but there is but one (1) wall provided with dividing or partition markings just to indicate the different sections of the apparatus.

As depicted in the front elevational view of FIG. 1, machine 10 preferably includes seven (7) hair color stations, denoted 12*a*, 12*b*, 12*c*, 12*d*, 12*e*, 12*f*, and 12*g*, adapted to hold hair color tubes 14 in an inverted configuration, i.e., with the caps of the respective tubes at the bottom of their respective stations and with the thin trailing ends of said tubes at the top of their respective stations. The viscosity of the hair coloring is high so that it does not drain from its tube when the cap is removed and the tube is inverted. Thus, the cap of each tube is removed prior to inserting it into its associated station.

The thin trailing end of each tube 14 is engaged by a pair of confronting rollers, collectively denoted 16, when the tube is properly positioned within its station. A small motor, not depicted to avoid cluttering the drawings, is adapted to cause rotation of said rollers upon receipt of a signal as more fully set forth hereinafter.

Each hair coloring tube 14 is mounted forwardly of vertical back wall 10*a* of apparatus 10.

Figure 2:
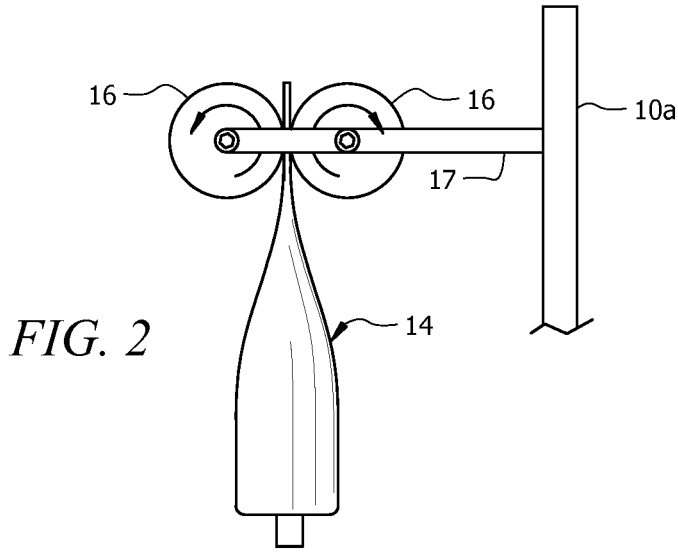
FIG. 2 is a sectional view taken along line 2-2 in FIG. 1.

FIG. 2 depicts a hair color tube 14 having its thin trailing end engaged by confronting rollers 16. When the rollers counter-rotate as indicated by the rotation arrows in FIG. 2, tube 14 is squeezed as it travels upwardly and hair coloring is dispensed from its leading end into a mixing bowl as disclosed hereinafter.

Returning to FIG. 1, colors 12*a*, 12*b*, and 12*c* are preferably grouped separately from the other colors but such separate grouping is not a requirement of the invention. These first three (3) colors are known in the industry as "low light" colors because they are used to darken the color of hair. The other four (4) colors are stronger and although the other four (4) colors are commonly mixed with one another in a multitude of combinations, they are never mixed with any of the three (3) low light colors.

First mixing bowl 20 is positioned below the three (3) low light colors and second mixing bowl 22 is positioned below the four (4) permanent colors, both of said bowls being supported by horizontal bottom wall 10*b*. When hair coloring is dispensed from a tube by operation of rollers 16, it falls under the influence of gravity into its associated bowl. The distance is relatively short and the hair coloring is highly viscous as aforesaid so no substantial splashing occurs.

A third mixing bowl 24 is positioned below discharge chute or dispenser 26*a* of bleach hopper 26 which is also positioned on the front side of vertical back wall 10*a* of apparatus 10. Bleach is provided in powder form so hopper 26 has a small dispenser at the bottom that is closed by a retractable plate or other suitable valve means having a normally closed position. The valve means is under the control of a small motor so that the powder may be dispensed in measured quantities.

Reference numerals 30*a*, 30*b*, 30*c*, 30*d*, 30*e*, 30*f*, and 30*g* respectively indicate reservoirs for holding liquid developers of increasing strength. Each of said developers is associated with a hair coloring tube 14 as depicted.

Reference numerals 30*h*, 30*i*, 30*j*, and 30*k* indicate reservoirs for holding liquid developers having the same potency as the developers denoted 30*d*, 30*e*, 30*f*, and 30*g*, respectively. Specifically, a developer having a potency of 1.9 is stored in first reservoir 30*a*, a developer having a potency of 5.0 is stored in second reservoir 30*b*, a developer having a potency greater than 5.0 but less than 10.0 is stored in third reservoir 30*c*, a developer having a potency of 10.0 is stored in fourth reservoir 30*d*, a developer having a potency of 20.0 is stored in fifth reservoir 30*e*, a developer having a potency of 30.0 is stored in sixth reservoir 30*f*, a developer having a potency of 40.0 is stored in seventh reservoir 30*g*, a developer having a potency of 10.0 is stored in eighth reservoir 30*h*, a developer having a potency of 20.0 is stored in ninth reservoir 30*i*, a developer having a potency of 30.0 is stored in tenth reservoir 30*j*, and a developer having a potency of 40.0 is stored in eleventh reservoir 30*k*.

Each reservoir is externally threaded at its uppermost end and capped by a large internally threaded cap 31*a-k*. Note that in this first embodiment, all of the developer reservoirs are mounted behind vertical back wall 10*a*.

Figure 3:
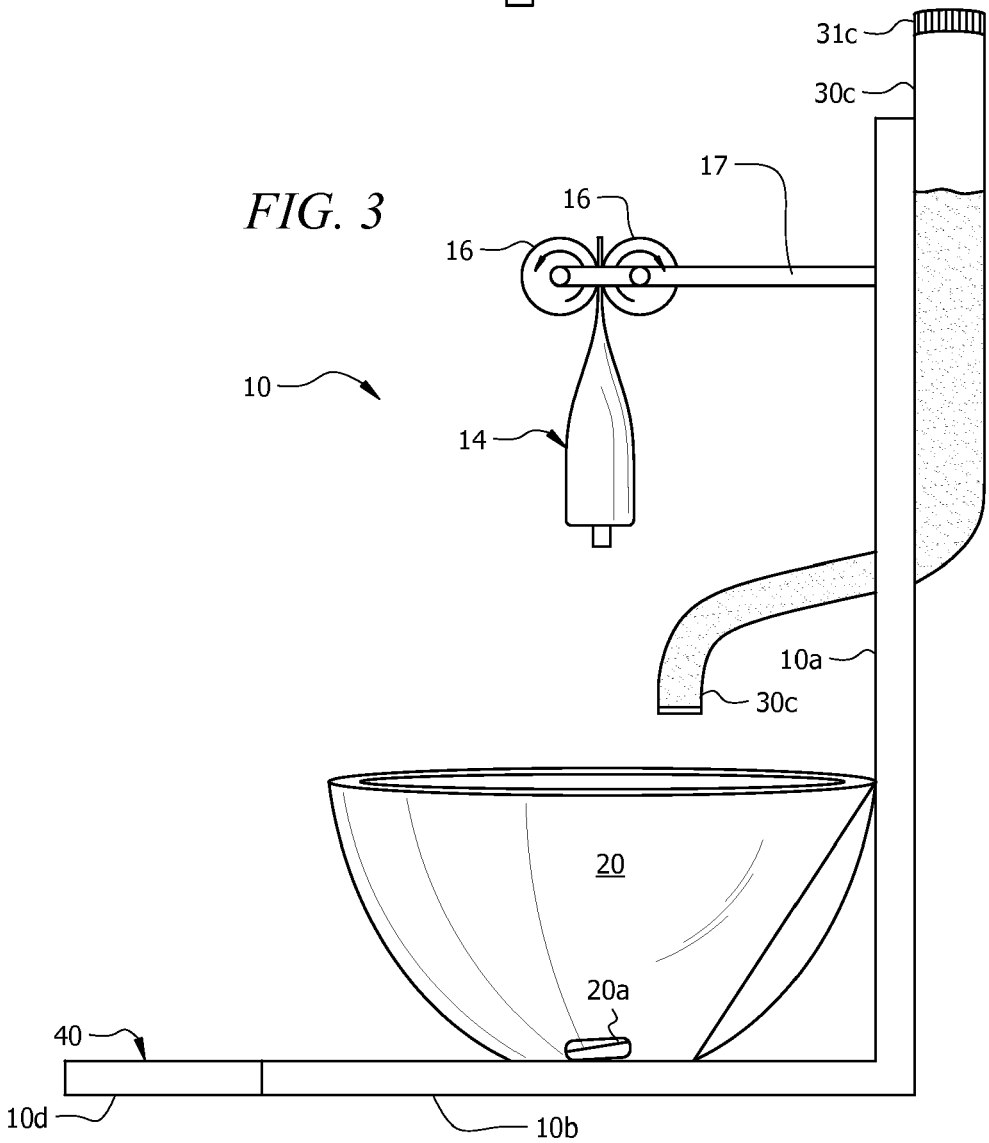
FIG. 3 is a sectional view taken along line 3-3 in FIG. 1.

The lower end of each reservoir has gradual bends formed therein so that each lower end is positioned over its associated mixing bowl, near the center thereof. Accordingly, back wall 10*a* of apparatus 10 has openings formed therein through which the respective lowermost ends of said reservoirs extend, as perhaps best understood by comparing FIG. 1 and FIG. 3. One of the horizontal brackets 17 for holding hair color tubes 14 is also depicted in FIG. 3.

Each reservoir lower end includes a developer dispenser that includes a normally closed valve means. A small motor controls the opening and closing of the valve means so that measured amounts of developer are released by gravity feed into a mixing bowl from each reservoir upon demand. The technology for metering rather precise amounts of liquids from reservoirs by gravity feed is quite advanced so it need not be repeated here.

An agitator is provided for each mixing bowl. Each agitator may be of conventional, overhead mounting where a vertical shaft depends from an overhead motor and extends downwardly into a mixing bowl. However, such an agitator would have to be removably mounted so that it could be removed when its mixing bowl is being charged with coloring and developer as will be the case with first and second mixing bowls 20, 22, or with developer and bleach as will be the case with third mixing bowl 24.

However, it is more convenient to use a magnetically-operated agitator that sits in its mixing bowl and is rotated by a rotating magnet positioned below bottom wall 10*b*. Such magnetically-operated agitators are commonly known as stirbars and may be ordered at www.stirbars.com. A stirbar 20*a* is depicted in dotted lines in FIG. 1 inside first mixing bowl 20, a stirbar 22*a* is similarly depicted in second mixing bowl 22, and a stirbar 24*a* is similarly depicted in mixing bowl 24.

Another alternative is to provide an auxiliary mixing station 28 at one end of novel apparatus 10. Auxiliary mixing station 28 includes a motor having an output shaft connected to a gear box or speed reducing means that is connected to shaft 29*a* of a mixing head 29. Auxiliary mixing bowl 32 is supported by bottom wall 10*b*. The auxiliary mixing station could also be provided with a stir bar in lieu of the motor, the mixing head, and the parts related thereto.

Instead of positioning the developer reservoirs behind vertical back wall 12*a*, said developer reservoirs can be placed in front of vertical back wall 10*a*, thereby eliminating the need to have openings in said vertical back wall. This embodiment, depicted in FIG. 4A in side elevational view, requires top wall 10*c* to support developers 30*a*-*k* and vertical brackets 17*a* for holding rollers 16. Horizontal brackets 17 and vertical brackets 17*a* are not depicted in FIG. 1 to avoid cluttering the drawing.

Figure 4A:
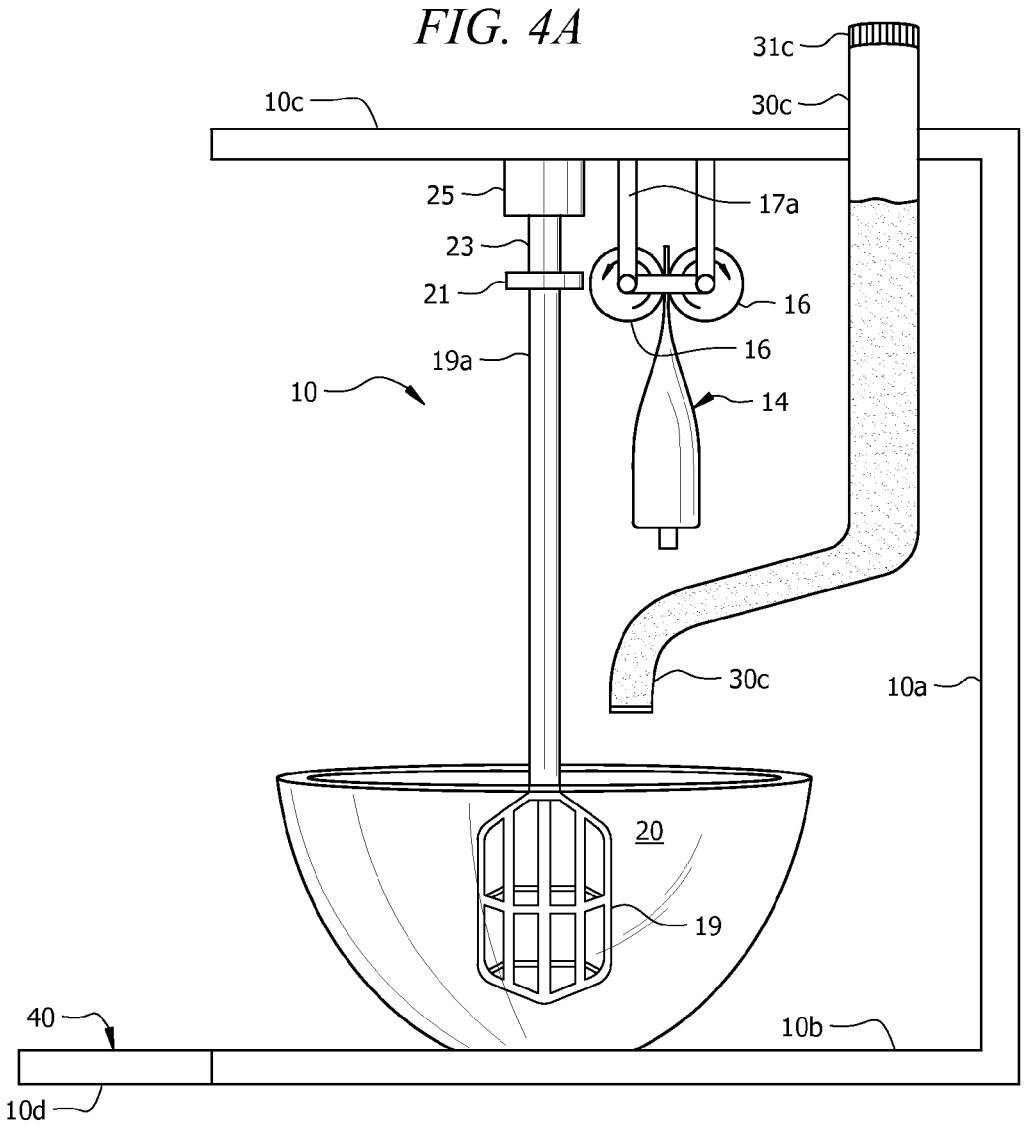
FIG. 4A is a view like that of FIG. 3 but depicting an embodiment where the developers are positioned forwardly of the rear wall of the apparatus.

FIG. 4A also depicts a conventional agitator 19 mounted to the free end of shaft 19*a*. Said shaft 19*a* is snap fit or otherwise releasably secured to coupler 21 that is mounted to the free end of output shaft 23 of motor 25. An agitator 19 and its associated parts may be provided with each of the three mixing bowls.

Figure 4B:
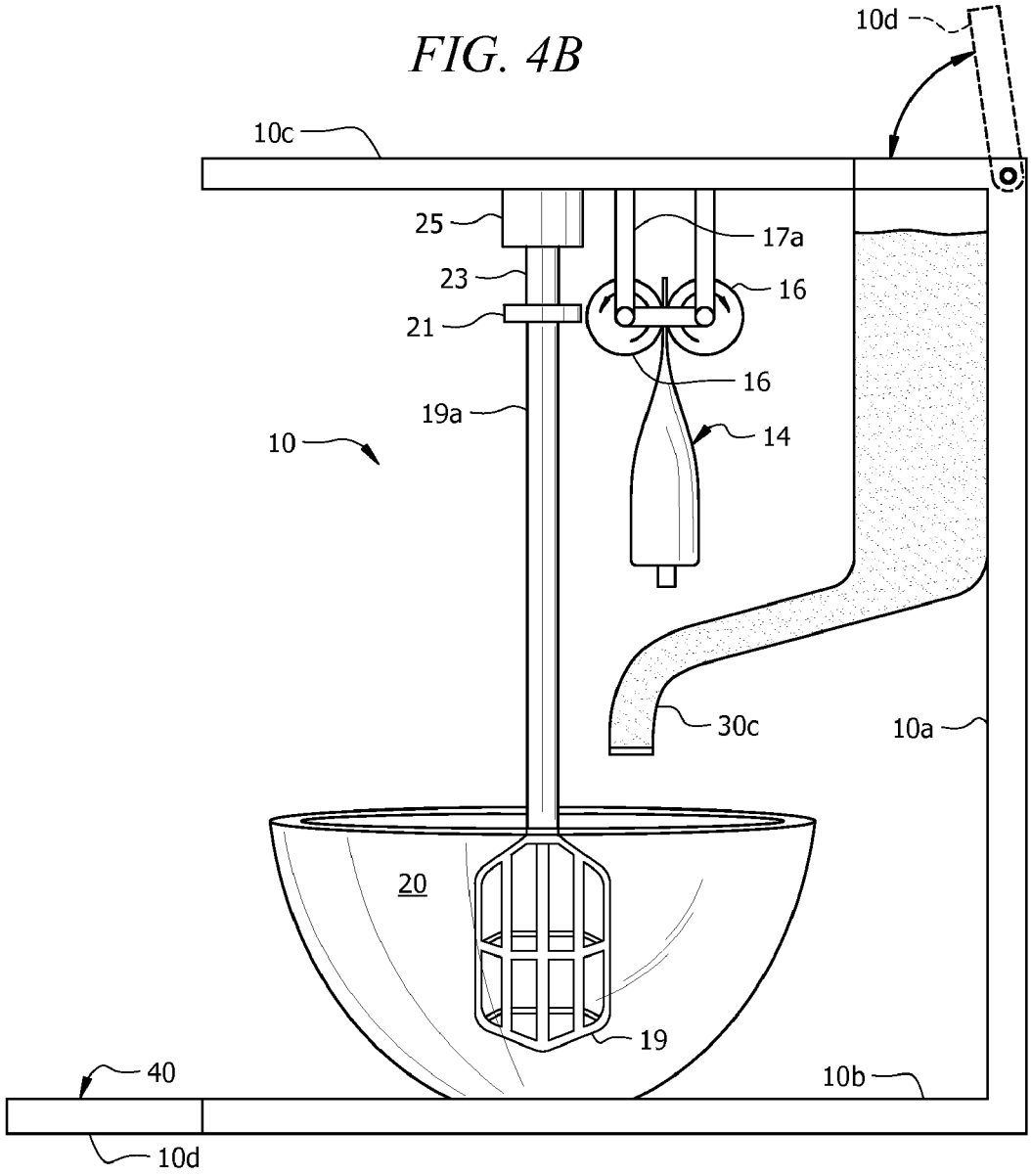
FIG. 4B is a view like that of FIG. 4A but depicting an embodiment where a partitioned tank for holding developer fluid is positioned forwardly of the rear wall of the apparatus.

FIG. 4B depicts a variation of reservoir tubes 30*a*-*k*. Although the lower, discharge end of each reservoir retains a tubular shape, the upper end thereof is provided in the form of a tank that includes back wall 10*a* and hinged lid 10*d*. Lid 10*d* eliminates the need for caps 31*a*-*k*, although it should be understood that each individual reservoir is partitioned from its contiguous reservoirs and individual hinged lids are within the scope of this invention.

Figure 5A:
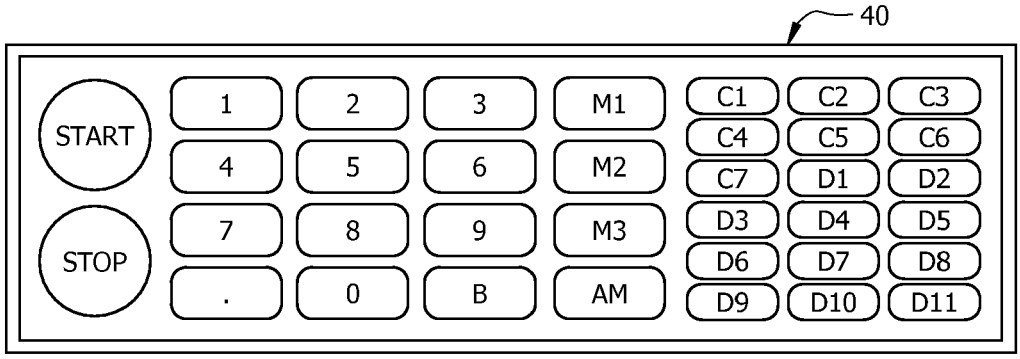
FIG. 5A is a view of a first keypad.

Reference numeral 40 in FIG. 5A denotes a keypad that includes the numbers 0-9 and operations such as start, stop, decimal point (.), color 1 (C1), color 2 (C2), color 3 (C3), color 4 (C4), color 5 (C5), color 6 (C6), color 7 (C7), developer 1 (D1), developer 2 (D2), developer 3 (D3), developer 4 (D4), developer 5 (D5), developer 6 (D6), developer 7 (D7), developer 8 (D8), developer 9 (D9), developer 10 (D10), and developer 11 (D11), first mixer (M1), second mixer (M2), third mixer (M3), auxiliary mixer (AM) and bleach (B).

Keypad 40 can be positioned at any convenient location on vertical back wall 10*a* but that wall may be relatively inaccessible. Accordingly, the preferred location of keypad 40 is bottom wall 10*d* which is an extension of bottom wall 10*b* as depicted in FIGS. 3 and 4.

Figure 5B:
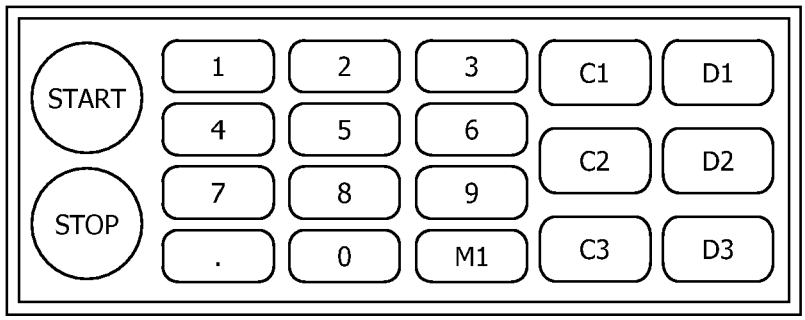
FIG. 5B is a view of a second keypad.

As an alternative to one large keypad for the entire machine, a separate keypad could be provided for each of the three sections of the machine. Thus, a keypad associated with the low light section of the machine, depicted in FIG. 5B, includes the numbers 0-9 and operations such as start, stop, decimal point (.), color 1 (C1), color 2 (C2), color 3 (C3), developer 1 (D1), developer 2 (D2), developer 3 (D3), and first mixer (M1).

Figure 5C:
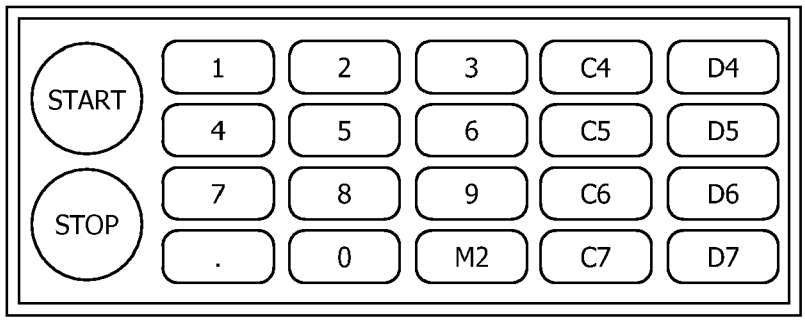
FIG. 5C is a view of a third keypad.

A keypad associated with the middle section of the machine, depicted in FIG. 5C, includes the numbers 0-9 and operations such as start, stop, decimal point (.), color 4 (C4), color 5 (C5), color 6 (C6), color 7 (C7), developer 4 (D4), developer 5 (D5), developer 6 (D6), developer 7 (D7), and second mixer (M2).

Figure 5D:
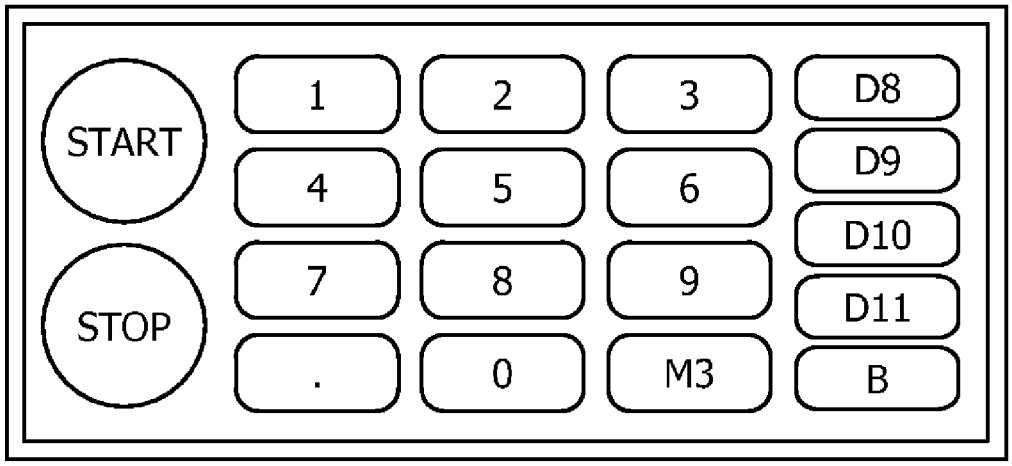
FIG. 5D is a view of a fourth keypad.

A keypad associated with the bleach section of the machine, depicted in FIG. 5D, includes the numbers 0-9 and operations such as start, stop, decimal point (.), developer 8 (D8), developer 9 (D9), developer 10 (D10), and developer 11 (D11), bleach (B), and third mixer (M3).

A keypad associated with the auxiliary mixer section of the machine would include operations such as start, stop, and third mixer (M3).

Prior to use of machine 10, a user positions preselected hair color tubes 1-7 in each station 12*a*, 12*b*, 12*c*, 12*d*, 12*e*, 12*f*, and 12*g* with the respective trailing ends 14*a* thereof in registration with their associated rollers 16. The caps are removed from each tube and they are inverted as depicted. Liquid developer reservoirs 30*a*, 30*b*, 30*c*, 30*d*, 30*e*, 30*f*, 30*g*, 30*h*, 30*i*, 30*j*, and 30*k* are then filled with developer liquids having a potency of 1.9, 5.0, 5.1-9.9, 10.0, 20.0, 30.0, 40.0, 10.0. 20.0, 30.0, and 40.0, respectively. Bleach hopper 26 is filled with bleach in powder form.

As an example of how machine 10 is used, a hypothetical case will be considered. Suppose a customer has some hair that the customer believes is too light in color so that customer would like to have that hair darkened slightly. The customer wants to change the color of some hair, and bleach some hair as well. The user of machine 10 must of course be familiar with low light hair coloring and how to mix it with developers, regular hair coloring and how to mix it with developers, and the bleaching process. In this hypothetical case, the user determines that 0.5 ounces of the first low light color should be mixed with 1.0 ounce of a developer having a potency of 1.9 and that 1.5 ounces of the second low light color should be mixed with 1.5 ounces of developer having a potency of 5.0. The keypad sequence is therefore: C1, 0.5, D1, 1.0, C2, 1.5, D2, 1.5, M1, Start, Stop. The time between pressing the "Start" and "Stop" keypads is determined by the efficiency of the stirbar or conventional agitator.

The user than performs a similar sequence for the regular hair coloring job and for the bleaching job. In a hypothetical case, the sequence for the regular hair-coloring, which involves only colors 3-6, the keypad sequence might be: C3, 2.5, D3, 2.0, C4, 1.5, D4, 1.5, C6, 0.5, D6 1.0, M2, Start, Stop. Note that the fifth color is not used in this example; any one color or any combination of said colors 3-6 and their associated developers may be used in the regular hair-coloring process. For the bleaching process, the keypad sequence might be: B, 1.5, C4, 1.0, D9, 0.5, C5, 1.0, D11, 1.0, M3, Start, Stop.

Operations involving auxiliary mixer (AM) 28 would work in the same way. After charging the desired combination of colors, developers, or bleach into a mixing bowl, that bowl would be placed into the auxiliary mixing station and the AM button on the keypad would be pushed, followed by the start button and the stop button when the mixing is finished.

Although this disclosure has not expressly identified the motors and sensors that will be required to accomplish the objects of this invention, it is believed that those of ordinary skill in the mechanical arts can select the motors and sensors that are required. For example, hair coloring is typically sold in six ounce (6 oz) tubes. The tubes are narrow at the end and wide at the mouth, like a common tube of toothpaste. There are several approaches to dispensing a preselected amount of coloring from a tube. A pressure transducer could be mounted below a mixing bowl so that when the desired amount of coloring has been deposited into the mixing bowl, the pressure transducer sends a signal to stop the motor that is causing the confronting rollers to rotate and squeeze the tube. In the alternative, experimentation could determine how many rotations of the rollers are needed to dispense half an ounce of coloring and the motor associated with each roller could be programmed to cause the correct amount of rotations when the keypad is used in the manner disclosed. Such would eliminate the need to weigh the mixing bowl as coloring is charged into it. Similar known technology could be used to discharge by gravity feed the correct amounts of liquid developer from their respective reservoirs. For both the liquid developers and the powdered bleach, level sensors could be employed to stop a motor when a detected level drops to a predetermined level, for example. Photoelectric sensors could also be employed. Again, those of ordinary skill in the art could select the most economical and suitable control mechanisms for accomplishing the objects of this invention without undergoing undue experimentation because the art of dispensing measured amounts of liquids and powders is well-developed. Moreover, adapting such well-known controls to keypad activation is also well within the ordinary skill of workers in the art.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for selectively dispensing and mixing hair coloring, developer, and bleach, comprising:

a housing including an upstanding back wall and a bottom wall extending forwardly from a lower end of said back wall;

at least one hair color tube station mounted on a forward side of said back wall;

at least one hair color tube squeezer positioned at said at least one hair color tube station, said at least one hair color tube squeezer being adapted to engage a trailing end of an inverted hair color tube;

a controller for said hair color tube squeezer that controls said hair color tube squeezer so that a preselected quantity of a preselected hair coloring can be squeezed from an inverted hair color tube;

at least one reservoir mounted to said apparatus, said at least one reservoir adapted to hold a developer;

a developer dispenser positioned at a discharge end of said reservoir;

a developer dispenser controller that controls said developer dispenser so that a preselected quantity of a preselected developer can be dispensed from said at least one reservoir;

at least one mixing bowl positioned forwardly of said back wall below a discharge end of said at least one hair color tube and said discharge end of said at least one reservoir; and a mixer for mixing hair color and developer discharged into said at least one mixing bowl.

2. The apparatus of claim 1, further comprising:

said at least one hair color tube squeezer including a pair of confronting rollers that engage said trailing end of said inverted hair color tube.

3. The apparatus of claim 2, further comprising:

said at least one hair color tube squeezer further including a motor for effecting counter-rotation of said pair of confronting rollers to accomplish squeezing of said at least one hair color tube; and said controller for said hair color tube squeezer controlling operation of said motor so that a preselected measured amount of hair color is squeezed from said at least one hair color tube.

4. The apparatus of claim 1, further comprising:

said at least one reservoir being mounted on a rearward side of said upstanding back wall;

at least one opening formed in said upstanding back wall so that a discharge end of said at least one reservoir extends through said at least one opening and is positioned forwardly of said upstanding back wall.

5. The apparatus of claim 1, further comprising:

said apparatus including a first hair color tube station dedicated to light colors;

said first hair color tube station including a plurality of hair color tube stations, a plurality of hair color tube squeezers, a plurality of reservoirs, and a first mixing bowl.

6. The apparatus of claim 5, further comprising:

said apparatus including a second hair color tube station dedicated to regular colors;

said second hair color tube station including a plurality of hair color tube stations, a plurality of hair color tube squeezers, a plurality of developer reservoirs, and a second mixing bowl.

7. The apparatus of claim 6, further comprising:

a second keypad enabling a user to program the hair color tube squeezer controller and the developer dispenser controller of the second station so that the user may preselect any combination and quantity of hair colors and developers to be dispensed into the second mixing bowl.

8. The apparatus of claim 5, further comprising:

a first keypad enabling a user to program the hair color tube squeezer controller and the developer dispenser controller of the first station so that the user may preselect any combination and quantity of hair colors and developers to be dispensed into the first mixing bowl.

9. The apparatus of claim 6, further comprising:

said apparatus including a bleaching station;

said bleaching station including a hopper adapted to hold bleach, a plurality of developer reservoirs, and a third mixing bowl.

10. The apparatus of claim 9, further comprising:

a bleach dispenser positioned at a discharge end of said hopper;

a bleach dispenser controller that controls said bleach dispenser so that a preselected quantity of bleach can be dispensed from said hopper.

11. The apparatus of claim 10, further comprising:

a third keypad enabling a user to program the developer dispenser controller and the bleach dispenser controller of the third station so that the user may preselect any combination and quantity of developers and bleach to be dispensed into the third mixing bowl.

12. The apparatus of claim 1, further comprising:

an auxiliary mixing bowl and a mixer attached to said apparatus.

13. The apparatus of claim 12, further comprising:

said mixer being provided in the form of a stirbar.

14. The apparatus of claim 12, further comprising:

said mixer being provided in the form of an agitator mounted to the free end of an elongate shaft;

a motor for rotating said elongate shaft;

said housing of said apparatus having a top wall that extends in cantilevered relation relative to said back wall;

said motor being secured to said top wall of said apparatus;

said motor having an output shaft;

a coupler mounted to said output shaft for conjoint rotation therewith;

said coupler adapted to enable releasable attachment of said elongate shaft to said coupler so that a user of said apparatus may attach said elongate shaft to said coupler or release said elongate shaft from said coupler whenever it is desired to add said agitator to said apparatus or to remove said agitator from said apparatus; and said elongate shaft being releasably engaged to said coupler.

15. The apparatus of claim 1, further comprising:

said at least one reservoir being mounted on a forward side of said upstanding back wall.

* * * * *